United States Patent [19]

Ikeda

[11] 4,362,405

[45] Dec. 7, 1982

[54] MOVING COIL TYPE PRINTING HEAD

[75] Inventor: Yoshiaki Ikeda, Tokyo, Japan

[73] Assignee: Seikosha Co., Ltd., Japan

[21] Appl. No.: 213,660

[22] Filed: Dec. 5, 1980

[51] Int. Cl.[3] ..... B41J 3/02; B41J 3/08

[52] U.S. Cl. ..... 400/121; 101/93.04

[58] Field of Search ..... 400/121, 124; 101/93.04, 93.05; 346/101

[56] References Cited

U.S. PATENT DOCUMENTS

| | | | |
|---|---|---|---|
| 3,467,232 | 9/1969 | Paige | 400/124 |
| 3,804,008 | 4/1974 | Hoyer | 101/93.04 |
| 3,834,304 | 9/1974 | Potter | 101/93.04 |
| 4,129,390 | 12/1978 | Bigelow | 400/121 |

FOREIGN PATENT DOCUMENTS

| | | | |
|---|---|---|---|
| 2437301 | 4/1975 | Fed. Rep. of Germany | 400/124 |

*Primary Examiner*—Paul T. Sewell

*Attorney, Agent, or Firm*—Robert E. Burns; Emmanuel J. Lobato; Bruce L. Adams

[57] ABSTRACT

A moving coil type printing head comprises a cantilevered printing lever comprised of a leaf spring having a printing element at its free end. The printing lever has a base portion supported by a holding member, two resilient leg portions integrally extending from the base portion, a triangular lever portion integral with the leg portions, and a tongue portion integrally extending from the base of the lever portion toward the base portion. A fulcrum member is attached to either the tongue portion or a plate member mounted on the holding member and is arranged so as to contact the other of the tongue portion and plate member. An excitable coil is secured to the triangular lever portion of the printing lever and coacts with a magnet flux generating circuit to effect movement of the coil and printing lever to carry out a printing operation.

14 Claims, 5 Drawing Figures

MOVING COIL TYPE PRINTING HEAD

The present invention relates to a moving coil type printing head capable of forming characters and so forth by a dot-matrix.

In the technical field of impact type dot printers, efforts have been made in recent years to develop a printing head employing one or more moving coils, however, this moving coil type printing head has, in the stage of the present development, several technical problems which must be resolved with respect to performance, response, reliability and so forth. For example, if a cantilevered printing lever driven by means of the moving coil is reduced in weight to enable it to be driven at a higher speed, its distortion and/or deflection increases so that it operates unstably and its response speed also drops due to the increased distortion and deflection. In addition, if a large current is applied in operation to the moving coil in order to form a clear dot, an excessive bending moment acts on to the printing lever between its fixture portion and its free end as a printing element (hammer) of the free end collides with a platen, so that the response mode of the printing lever becomes irregular.

It is an object of the invention is to provide a novel moving coil type printing head having an excellent performance, response and reliability and which is capable of application to commercial use.

Another object of the invention is to produce a light and compact impact type printing head at a very low cost.

Still another object of the invention is to provide an impact type printing head which can be assembled easily.

Figure 1:
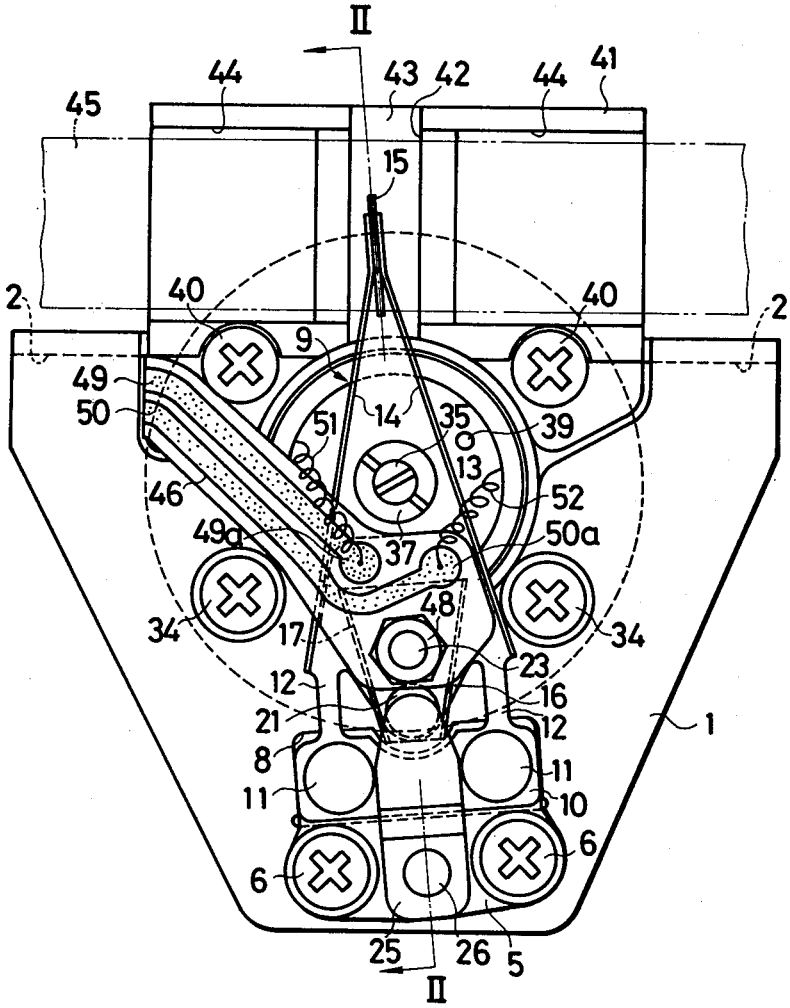
Figure 2:
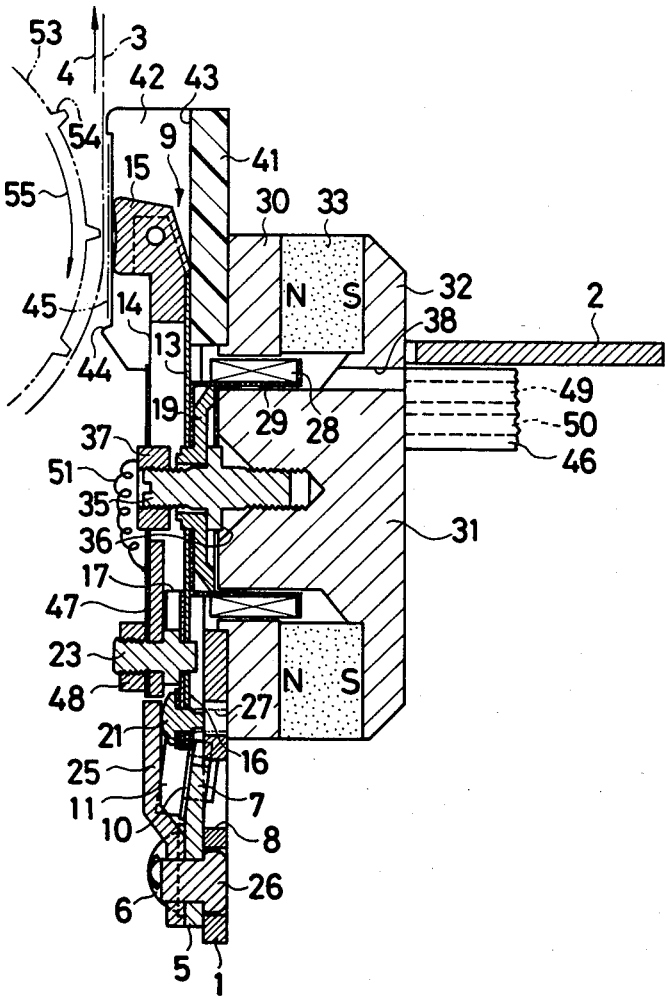
Figure 3:
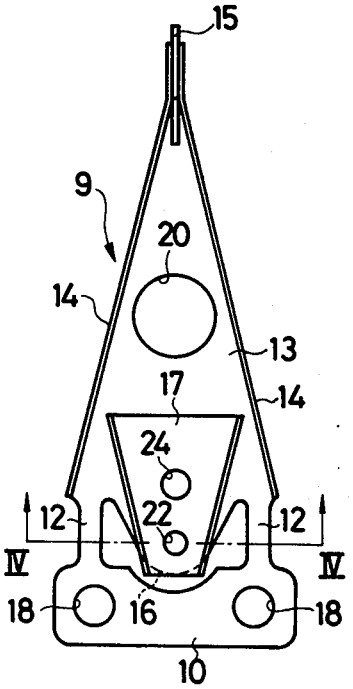
Figure 4:
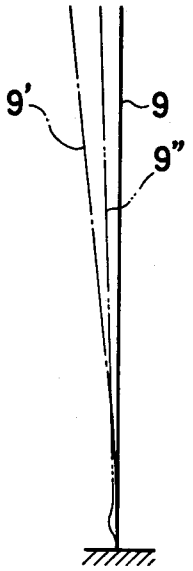
Figure 5:
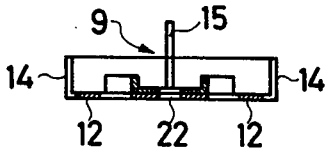

The other features, objects and advantages of the invention will be more fully understood from the following description in accordance with attached drawings in which;

FIG. 1 is a front elevational view of the printing head constituted in accordance with the invention, FIG. 2 is a cross sectional view taken along the line II—II of FIG. 1, FIG. 3 is a front elevational view of the printing lever employed in the printing head, FIG. 4 is a cross sectional view taken along the line IV—IV of FIG. 3, and FIG. 5 is a view for explanation of the deflection of the printing lever.

An embodiment of the moving coil type printing head constituted in accordance with the invention will be described hereinunder.

Referring to FIGS. 1 and 2, a carrier plate 1 has an L-shaped cross section and its transverse bent portion 2 is supported on a carriage (not shown) which is adapted to be scanned in a direction transverse to the direction of advance of paper to be printed on, i.e. transverse to the direction indicated by an arrow 4. This carrier plate 1 carries a holding plate 5, being an example of a holding member, on its lower front surface. The holding plate 5 is secured to the lower portion of the carrier plate 1 by means of screws 6, 6, and its upper portion 7 is inclined backward, i.e. in a direction opposite to the direction of actuation of a printing lever 9, at a predetermined angle, e.g. at above five degrees. In addition, the upper portion 7 extends into a rectangular opening 8 which is bored in the carrier plate 1, and the cantilevered printing lever 9 is secured to the inclined upper portion 7 by means of pins 11, 11. As shown in FIG. 3, the printing lever 9 is constructed by a rectangular base portion 10 which is secured to the upper portion 7 of the holding plate 5, resilient leg portions 12, 12 which are integrally extend upward from the base portion 10, and a triangular lever portion 13 which is connected integrally with the resilient leg portion 12, 12. The printing lever 9 is made in a body of a thin leaf spring in order to reduce in weight, and the lever portion 13 is provided at its lateral edges with beam-like flange portions 14, 14, which are folded forward at a right angle, in order to enhance the stiffness thereof. In consequence, the printing lever 9 substantially takes charge of its deflection at the part of the resilient leg portions 12, 12. Further, the lever portion 13 has a knife-like printing hammer 15, being an example of a printing element, at its free end. The printing member 15 is clamped like a sandwich between the top ends of the flange portions 14, 14 and fixed therebetween by means of adhesive, or spot welding. In addition, the lever portion 13 has a tongue portion 16 which is integrally formed to extend toward the base portion 10 from its lower base of the lever portion 13 between the resilient leg portions 14, 14, and a reinforce member 17 is fixed on the tongue portion 16. The base portion 10 has two holes 18, 18 which the pins 11, 11 seen in FIG. 1 can be passed through, and a hole 20 for securing a discoid bobbin holder 19 seen in FIG. 2 is bored in the lever portion 13 at its central part. Furthermore, each of the tongue portion 16 and the reinforce member 17 has a hole 22 which a pin 21 being an example of a fulcrum member as seen in FIGS. 1 and 2 can be loosely passed through and a hole 24 which the rear end of a post-like member 23 seen in FIGS. 1 and 2 is forced therein. As clearly seen in FIG. 2, an arm-like plate member 25 is secured to the holding plate 5 by means of a pin 26, and the pin 21 is secured to the tongue portion 16 so as to be in contact with the arm-like plate member 25 according to the following steps of assembly. Namely, in the first step, the pin 21 is passed through the hole 22 (seen in FIG. 3) so that it is movable axially. Thereafter, the arm-like plate member 25 is secured to the holding plate 5, and thus the pin 21 comes to be unable to fall out from the hole 22. In this step, the carrier plate 1 carries nothing on its rear surface yet, and biasing means comprised of a coil spring 27 is inserted through an aperture which is bored in the carrier plate 1 at a position corresponding to the pin 21, and this aperture is shut up by an outer yoke member 30 which is secured to the carrier plate 1 on its rear surface. As a consequence, the pin 21 is biased toward the arm-like plate member 25 by virtue of the biasing force of the coil spring 27 and contacts closely with the member 25. Under this contacting stage, adhesive is painted under the headed portion of the pin 21, and thus the pin 21 is secured to the tongue portion 16 and the reinforcing member 17 as a result of hardening of adhesive. According to the assembly method as described above, even though the arm-like plate member 25 does not have good positioning accuracy, the pin 21 can be secured to the tongue portion 16 and the reinforcing member 17 so as to surely contact with the arm-like plate member 25, thus no adjustment of position of the pin 21 or the arm-like plate member 25 is required. In this embodiment, the pin 21 is adapted to contact with the arm-like plate member 25 at a position substantially corresponding to one-third of the total length of the resilient leg portions 12, 12. Other effects which can be obtained by such a supporting configuration for the printing lever 9 will be clarified in the description of the operation of the printing head.

As shown in FIG. 2, the bobbin holder 19 which is secured to the hole 20 (seen in FIG. 3) holds a cylindrical bobbin 29 around which a moving coil 28 is wound, and the moving coil 28 is adapted to be electromagnetically coupled with a magnetic flux generating means which is constituted by an outer yoke member 30 having an annular shape, a center yoke member 31 positioned in the central opening of the outer yoke member 31, and an annular permanent magnet 33 sandwiched between the outer yoke member 30 and a rear discoid portion 32 integrally formed from the center yoke member 31. The outer and center yoke members 30, 31 are made of a magnetic material having a high magnetic permeability, and magnetized to have opposite magnetic poles by virtue of a magnetic force of the permanent magnet 33 respectively. The moving coil 28 is disposed in an air gap between the outer and center yoke member 30, 31, and the magnetic flux is generated radially across the moving coil 28 in the air gap. The outer yoke member 30, the permanent magnet 33 and the center yoke member 31 are connected to one another by means of adhesive, and the outer yoke member 30 is fixed on the rear surface of the carrier plate 1 by means of screws 34, 34 as seen in FIG. 1, thereby, the whole of the magnetic flux generating means is carried on the carrier plate 1.

The center yoke member 31 is provided at its center with a stopper screw 35 which functions as a control member to restrict the range of displacement of the printing lever 9. The stopper screw 35 has a rear threaded screw portion which is screwed into the center yoke member 31 so as to be adjustably positioned, and a flange 36 which is integrally formed therefrom at its intermediate portion is arranged to be in contact with the rear surface of the bobbin holder 19, so that the rest position of the printing lever 9 is determined. At this rest position, the printing lever 9 is bowed forcedly somewhat at its resilient leg portion 12, 12 due to the inclination of the upper portion 7 of the holding plate 5 on which the printing lever 9 is supported, therefore, the bobbon holder 19 is in contact with the flange 36 at a suitable contact pressure. In addition, the stopper screw 35 has a front threaded screw portion around which a nut 37 is screwed so as to be adjustably positioned, and the range of displacement or swing of the printing lever 9 is adapted to be restricted also by the nut 37.

The center yoke member 31 is provided in its bottom with an air loophole 38 which communicates with the air gap in which the moving coil 28 is disposed toward the external part as shown in FIG. 2, and the bobbin 29 and the bobbin holder 19 also are provided with an air loophole 39 as seen in FIG. 1. The air loophole 39 communicates with an air-tight space which is formed between the bobbin holder 19 and the center yoke member 31 as shown in FIG. 2 toward the external part.

As shown in FIGS. 1 and 2, a ribbon guide 41 secured to the outer yoke member 30 by means of screws 40, 40 is located behind the printing hammer 15. The ribbon guide 41 has a longitudinal groove 42 formed at its central portion, and when the printing lever 9 is positioned at the above-mentioned rest position, its free end also is adapted to be in contact lightly with a bottom surface 43 of the groove 42. In other words, the ribbon guide 41 also assists in functioning as a stopper to determine the rest position of the printing lever 9. The ribbon guide 41 is provided at the both sides of the groove 42 with guide grooves 44, 44 by which an inked ribbon 45 arranged between the paper 3 and the printing hammer 15 is conducted.

A flexible flat cable 46 is arranged to apply a driving current to the moving coil 28, and a plate member 47 is affixed on a rear surface of an end of the cable 46 by means of adhesive. This end of the cable 46 is attached to the pin 23 through a nut 48. The cable 46 is provided with thin film conductors 49, 50 having terminals **49*a*, 50*a* to which lead wires 51, 52 for connection to the moving coil 28** are connected respectively.

A platen 53 illustrated by a broken line in FIG. 2 is disposed to oppose to the printing hammer 15, and a plurality of projections 54 are integrally formed parallel to its axis at an equipitch on its periphery. Corresponding to the projections 54, the printing hammer 15 has an arced front surface having a radius of curvature equal to the rotative radius of the projections 54. When the printing lever 9 is in its rest position as shown in FIG. 2, the center of curvature of the front surface of the printing hammer 15 is deviated from the center of the platen 53 corresponding to the swing angle of the printing lever 9. Namely, the center of curvature is positioned above the center of the platen 53. However, as the printing hammer 15 will be operated to collide with one of the projections 54 in order to form a dot on the paper 3, the center of curvature of the front surface of the printing hammer 15 will be moved to substantially coincide with the center of the platen 53.

Moreover, in the above-described embodiment, all of the parts excepting the outer and center yoke members 30, 31 and the permanent magnet 33 are made of a suitably selected non-magnetic material such as stainless steel, phosphor bronze, brass, or plastics.

The printing head constructed as described above in accordance with the invention operates in the following manner.

If a driving pulse current is applied to the moving coil 28 through the conductors 49, 50 of the cable 46 when the printing lever 9 is in the rest position as shown in FIG. 2, the moving coil 28 is electromagnetically coupled with the magnetic flux in the air gap between the outer and center yoke member 30, 31 and thus a force for deflection is produced by the moving coil 28 under Fleming's rule. Consequently, the printing lever 9 is deflected or swung leftward against a spring force of the resilient leg portions 12, 12. Since the lever portion 13 has a high stiffness by virtue of the flange portions 14, 14 and the pin 21 secured to the tongue portion 16 and the reinforcing member 17 is in contact with the arm-like plate member 25, the printing lever 9 is swung about the pin 21, i.e. about the line IV—IV of FIG. 3, as indicated by the reference number 9'. Namely, the printing hammer 15 makes a perfect circular motion substantially about the pin 21, and causes the inked ribbon 45 and the paper 3 to impact to one of the projections 54 and thus a dot is formed on the paper 3 through a collision of the printing hammer 15 and one of the projections 54. After the printing hammer 15 collides with the corresponding projection 54, the intermediate portion of the printing lever 9 is still applied the motion of deflection due to the action of inertia, but thereafter the front end of the bobbin holder 19 is in contact with the nut 37, therefore the deflection due to the action of inertia is restricted and a considerable bending or deflecting force is not applied to the printing lever 9 during its actuation. Thereafter the printing lever 9 is returned from the actuated position toward the rest position by virtue of a return force of the resilient leg portions 12, 12. On the other hand, the printing head is scanned also in a direction transverse to the direction of advance of the paper 3 at the same time as the printing lever 9 is actuated as described above, and the platen 53 is continuously rotated in an arrowed direction 55 as seen in FIG. 2 by means of a driving motor (not shown). In consequence, positions where the printing hammer 15 crosses with the projections 54 are moving in vertical and horizontal directions in accordance with the scanning of the printing head and the rotation of the platen 53, and then the printing lever 9 is actuated at a suitably selected position and timing, therefore the desired characters, graphs, pictures and so forth are formed by a dot matrix. The detailed printing operation has not been described herein because such is unnecessary for an understanding of the invention, however, it has been disclosed in Japanese application No. 119506/79 filed at Sept. 17, 1979 "IMPACT TYPE DOT PRINTER" applied for by the same applicant as that of the present invention.

Additional effects and advantages which can be obtained by the supporting structure of the printing lever 9 comprising the tongue portion 16, the reinforcing member 17, the pin 21, the arm-like plate member 25 and so forth will be clearly understood from the following description.

If the tongue portion 16, the reinforcing member 17, the pin 21 and the arm-like plate member 25 are not employed, then when the printing lever 9 receives the abrupt actuating force from the moving coil 28, it will become distorted in a moment at the part of the resilient leg portions 12, 12 as indicated by the reference number 9" due to the inertia of the printing hammer 15 and so forth, and then the lever portion 13 will start to move leftward. Namely, as compared with the structure of the invention, the actuation of the printing hammer 15 will be delayed and the response of the printing lever 9 will be far worse, therefore it will be difficult to actuate the printing lever 9 at a high speed. Such disadvantages or troubles will be more pronounced if the lever portion 13 does not have the flanges 14, 14 at its lateral edges. On the contrary, the provision of the supporting structure of the printing lever 9 in accordance with the invention prevents the above-mentioned abnormal distortion of the resilient leg portions 12, 12, thus the printing lever 9 can be actuated in a stable manner at a high response speed, and a sure printing force can be produced.

In addition, since the air loopholes 38, 39 open into the center yoke member 31, the bobbin 29 and its holder 19, the moving coil 28 receives little air resistance when it is actuated in the air gap between the outer and center yoke members 30, 31, therefore it can be actuated in a precise manner at a high speed. Also, since the cable 46 having the terminals 49*a*, 50*a* for connection of the lead wires 51, 52 is attached to the printing lever 9 through the pin 23 and the nut 48 so as to move together with the printing lever 9, there is no relative motion between the moving coil 28 and the end of the cable 46. Consequently, the lead wires 51, 52 receives no repeated stress and can have a long life although the printing lever 9 is repeatedly actuated at high speed during long periods of time.

Moreover, if the ribbon guide 41, which is adapted to have a function as a stopper to restrict a needless motion of the free end (the printing hammer 15) of the printing lever 9 just after returning to the rest position thereof, is made of a soft plastics, a shock may be absorbed so that the vibration or rebound of the printing lever 9 may be damped in a moment, and the driving sound may become more silent. To reduce the driving sound and the undesired vibration of the printing lever 9, a damping member such as an elastic rubber or a sponge can be arranged between the holder 19 and the flange 36. If desired, a wire can be used as the printing element instead of the knife-like printing hammer 15. However, in the case of the printing wire, the platen 53 should be modified to be arranged in stationary fashion and to form a flat surface opposing the printing wire. The holding plate 5 can be formed integrally from the carrier plate 1, however, considering assembly or maintenance of the printing lever 9, the structure of the invention is very convenient and practical. In addition, the means for restraining the abnormal distortion also can be modified. For example, the pin 21 can be secured to the arm-like plate member 25 and then the pin 21 placed in contact with the tongue portion 16 at the position of the line IV—IV of FIG. 3.

As described above in detail, the provision of the invention enables the moving coil type printing head to yield a good performance, response and reliability capable of application to practical use. Especially, the printing lever can make substantially a perfect circular motion about the fulcrum member without inducing the abnormal deflection or distortion at the position of the resilient leg portions thereof even if a large current is applied to the moving coil so as to provide the printing lever with a sufficient displacement force, therefore, the printing lever is actuatable at a high speed and applies a sufficient printing force so that a clear dot can be formed by the printing element. In addition, since the printing lever is supported by the inclined portion of the holding member so that a suitable biasing return force is applied backwards to it, it can be returned rapidly toward the rest position thereof after each printing operation and stably maintained at the rest position. Further, since the printing lever is releasably mounted on the carrier plate through the holding member, its assembly and maintenance are comparatively easy. Since the printing lever can have a sufficient stiffness by virtue of the flange portions formed at the opposed edges of the lever portion thereof, it can accurately transmit the printing force to the printing element. Still further, since there is the air loophole opened from the air gap toward the external part in the magnetic generating means, the moving coil disposed in the air gap can be actuated in a sensitive manner at a high speed of response. Furthermore, the printing lever can be controlled the range of displacement thereof by the control means carried on the magnetic flux generating means, thus it can be actuated in a stable manner without inducing a considerable deflection or distortion. Moreover, the moving coil type printing head can be manufactured in a light weigh weight and a compact size at a low cost.

What I claim is:

1. A moving coil type printing head comprising: a cantilevered printing lever comprised of a leaf spring and having at a free end thereof a printing element opposing a platen; a movable coil secured to said printing lever for movement therewith; magnetic flux generating means for producing a magnetic flux which intersects said movable coil to effect movement of the coil; said printing lever having a base portion supported by a holding member, two resilient leg portions integrally extending from said base portion, a triangular lever portion integral with said leg portions and carrying said movable coil, and a tongue portion integrally extending from the base of said lever portion toward said base portion; and a fulcrum member attached to one of said tongue portion and a plate member mounted on said holding member so as to be in contact with the other of said tongue portion and said plate member.

2. A moving coil type printing head as claimed in claim 1; in which said holding member has a portion which is inclined away from the direction in which said printing lever is actuated and to which said base portion of the printing lever is secured.

3. A moving coil type printing head as claimed in claim 1 or 2; in which said holding member is releasably mounted on a carrier plate which carries said magnetic flux generating means.

4. A moving coil type printing head as claimed in claim 1 in which said fulcrum member is disposed at a position substantially corresponding to one-third of the total length of said leg portions from said base portion.

5. A moving coil type printing head as claimed in claim 1; in which said printing lever is symmetrical with respect to its center line.

6. A moving coil type printing head as claimed in claim 1 or 5; in which said printing lever has flange portions at opposite lateral edges thereof to increase the stiffness of the printing lever.

7. A moving coil type printing head as claimed in claim 6; in which the printing element has a bar shape and is clamped between the proximal ends of said flange portions.

8. A moving coil type printing head as claimed in claim 1; in which said platen is rotatably mounted and is provided on its outer periphery with a plurality of circumferentially spaced projections extending substantially parallel to the axis thereof and selectively positionable so as to be opposed from said printing element in response to rotation of said platen.

9. A moving coil type printing head as claimed in claim 8; in which the printing element has an arced striking surface whose radius of curvature corresponds to the radius of rotation of said projections.

10. A moving coil type printing head as claimed in claim 9; in which the center of said radius of the printing lever is deviated from the center of said platen when the printing lever is positioned at its rest position, and the center of said radius of curvature coincides substantially with the center of said platen when said printing element collides with said platen.

11. A moving coil type printing head as claimed in claim 1; in which said movable coil has a cylindrical shape; and said magnetic flux generating means comprises a center yoke member, an annular outer yoke member surrounding said center yoke member so as to define an annular air gap between said center and outer yoke members and in which said moving coil is disposed, an annular permanent magnet sandwiched between said center and outer yoke members, and a rear discoid portion integral with said center yoke member.

12. A moving coil type printing head as claimed in claim 11; in which said center yoke member has at least one air passageway passing through the exterior thereof.

13. A moving coil type printing head as claimed in claim 11 or 12; in which said center yoke member has control means adjustably mounted thereon so as to adjustably restrict the range of displacement of the printing lever.

14. A moving coil type printing head as claimed in claim 13; in which said control means comprises an abutment screw adjustably screwed to said center yoke member through said printing lever, and said abutment screw has a flange integrally formed from an intermediate part thereof so as to determine the rest position of said printing lever and a nut adjustably screwed to the abutment screw so as to prevent overdeflection of said printing lever.

* * * * *